US005903299A

United States Patent [19]

Kawano

[11] Patent Number: 5,903,299

[45] Date of Patent: May 11, 1999

[54] THERMAL COLOR PRINTER

[75] Inventor: Junji Kawano, Ise, Japan

[73] Assignee: Shinko Electric Co., Ltd., Tokyo, Japan

[21] Appl. No.: 08/831,921

[22] Filed: Apr. 2, 1997

[30] Foreign Application Priority Data

Apr. 9, 1996 [JP] Japan ..... 8-086912

[51] Int. Cl.[6] ..... B41J 33/36

[52] U.S. Cl. ..... 347/217; 347/215; 400/232

[58] Field of Search ..... 347/215, 217; 400/223, 224.1, 224.2, 225, 232, 235, 235.1

[56] References Cited

U.S. PATENT DOCUMENTS 5,064,301 11/1991 Nakamura et al. .
5,372,439 12/1994 Poole et al. .
5,445,463 8/1995 Paranjpe .
5,631,688 5/1997 Hibino et al. .

FOREIGN PATENT DOCUMENTS 0 440 232 0 8/1991 European Pat. Off. .
1-14072 1/1989 Japan .
2-208058 8/1990 Japan .
5-301471 11/1993 Japan .
2 282 567 4/1995 United Kingdom .

OTHER PUBLICATIONS

N. Taguchi et al., "Multi–Usable Printing Characteristics of Dye Transfer Sheets", *Proceedings of the Institute of Electronics, Information and Communication Engineers (IEICE)*, vol. J70–C, No. 11, pp. 1537–1544, Nov., 1987.

*Primary Examiner*—Huan Tran
*Attorney, Agent, or Firm*—Darby & Darby

[57] ABSTRACT

A compact thermal color printer enables the use of a thermal type printing medium having heat sublimation type inks for a multiple-print use and a heat melting type ink for a single-print use. In the process of printing characters or symbols, using the two types of inks, by pressing the printing medium against a print object through a thermal head, the transport distances for the thermal print medium and the print object are adjusted, depending on whether a heat sublimation type ink is being printed or a heat melting type ink is being printed. This arrangement for the transport distance adjustments enables to simplify the printer drives to make the apparatus more compact, and enables to reduce consumption of the sublimation type inks for color printing and increases the service life of the printing ribbon to reduce the operating cost.

7 Claims, 4 Drawing Sheets

THERMAL COLOR PRINTER

BACKGROUND OF THE INVENTION

1. Field of the Invention

The present invention relates in general to thermal color printers, and relates in particular to a printing technology using a thermal printing medium (ink ribbon) based on heat sublimation type inks.

2. Description of the Related Art

In a Japanese Patent Application, First Publication, H05-301471, a printing technology is disclosed, based on the use of a multiple-print ink ribbon (permitting repeated printing from one ribbon) based on heat sublimation type inks. The multiple-print ink ribbon has a thick coating of heat sublimation type inks to enable repeated printing from the same ribbon. On the other hand, the single-print ink ribbon based on heat melting wax ink is made by applying a mixture of face coloring or carbon in a wax binder on a ribbon base material. When heat is applied to the coated ribbon, the binder wax melts and transfers all of the heated coating to a print object. Because the heat melting ink transfers all of the face coloring or carbon (black) to the print object upon melting of the wax, the ribbon is not capable of providing multiple printing, even if a thick coating is applied on the ribbon as is the case for the heat sublimation type inks.

In the present state of development of the thermal transfer type color printers, single-print ribbon printers are predominant in the marketplace, and multiple-print ribbons have not yet become a commercial reality. However, in using the multiple-print ribbons, it has been recognized that by arranging the relative movement of the ribbon with respect to the print base to be 1/N, for example, (where N is the number of times the multiple-point ribbon can be repeatedly used), ink consumption can be significantly reduced that the service life of the thermal transfer ribbon can be improved. There has therefore been a serious need to develop a thermal transfer type color printers that permits the use of a multiple-print ribbon.

SUMMARY OF THE INVENTION

It is an object of the present invention to provide a thermal color printer apparatus to enable the use of a thermal printing medium having heat sublimation type inks for printing of multi-print color images and heat melting type inks for printing of single-print characters and symbols. It is another object of the present invention to provide a compact thermal printer to enable the use of the thermal printing medium.

The object has been achieved in a thermal printer apparatus comprising: a thermal printing medium having heat sublimation type inks for multiple-print use and heat melting type inks for single-print use; transport means for moving the thermal printing medium and a print object in a state of pressed contact; and a thermal head for applying heat to the thermal printing medium so as to transfer the heat sublimation type inks and the heat melting type inks onto the print object, wherein the apparatus is provided with medium transport distance control means for adjusting a transport distance of the thermal printing medium with respect to the print object on a basis of whether a current printing process relates to a heat sublimation type ink or a heat melting type ink.

A second aspect of the printer apparatus is that the medium transport distance control means selects a medium transport distance to be equal to a print object transport distance N for the heat melting type ink, and selects a medium transport distance to be equal to 1/N of the print object transport distance N for the heat sublimation type ink.

A third aspect of the printer apparatus is that a medium driving means precedes the thermal head in relation to a forwarding direction of the thermal printing medium.

A fourth aspect of the printer apparatus is that the medium driving means comprise: a roller for pressing against a thermal printing medium; a pulse motor for rotating the roller through a given rotational angle in accordance with control signals output from the medium transport distance control means; and force transmission means disposed between the roller and the pulse motor for controlling application of rotational force of the pulse motor to the roller.

A fifth aspect of the printer apparatus is that the print object includes a magnetic card, and integrated circuit card and radio card.

The printer apparatus provides the following advantages over the conventional thermal type printers.

(1) Because of the provision of adjusting the thermal medium transport distance with respect to the print object, depending on whether the heat sublimation type inks or heat melting type ink is being used, the medium transport distance can be optimized to suit the type of ink being used so that heat sublimation type inks are used for multiple-print of color images while heat melting type ink is used for single-print of characters and symbols.

(2) The medium transport distance control device adjusts the transport distance of the thermal printing medium such that, when using the heat melting type ink, the medium transport distance N is the same for both types of inks, but when using the heat sublimation type inks, the medium transport distance is adjusted to be 1/N. Therefore, the length of the printing medium required for printing color images is 1/N of the length of the printing medium required for printing characters and symbols, thus reducing the consumption of the thermal printing medium for color image printing significantly, and lowering the cost of color printing per image frame.

(3) Because of the provision of the medium transport distance control device to adjust the transport distance for the printing medium, depending on whether the heat sublimation type inks or the heat melting type ink are being used, only one driving system is needed to transport both the print object as well as the thermal printing medium. The result is a considerable reduction in the cost of the printer apparatus as well as in the size of the printer apparatus.

(4) Because the medium driving device to enable the thermal medium to move forward is positioned in front of the thermal printer head, it is possible to provide an effective and precise control over the medium transport distance.

DESCRIPTION OF THE PREFERRED EMBODIMENTS

Figure 1:
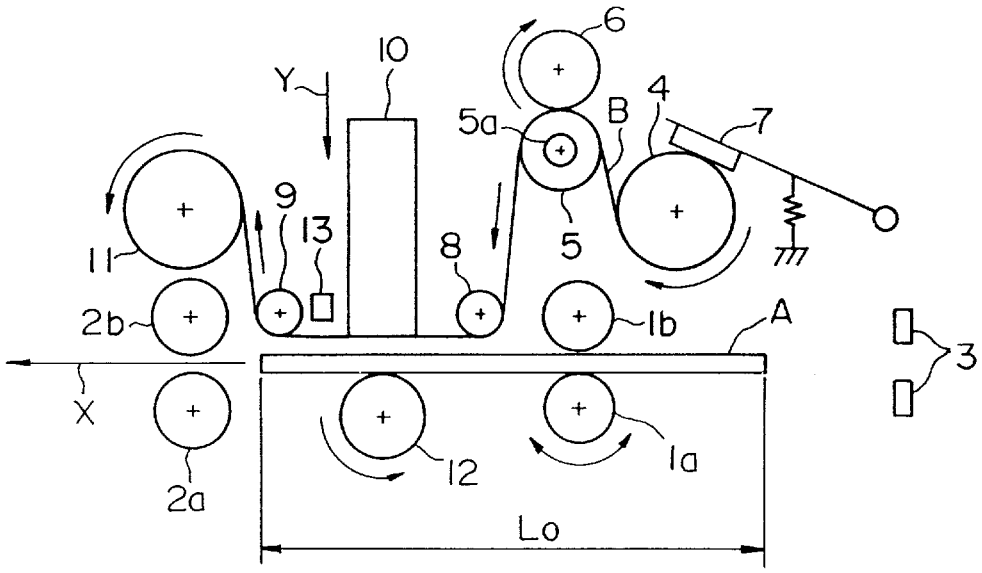
FIG. 1 is a plan view to show the printer driving system of a first embodiment of the thermal color printer of the present invention.
Figure 2:
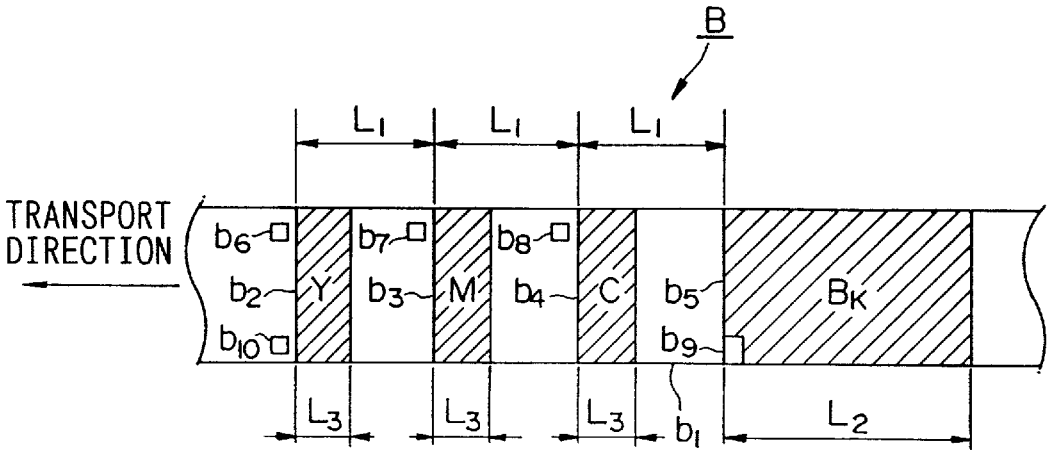
FIG. 2 is a plan view of an embodiment of the thermal printing medium of the present invention.
Figure 3:
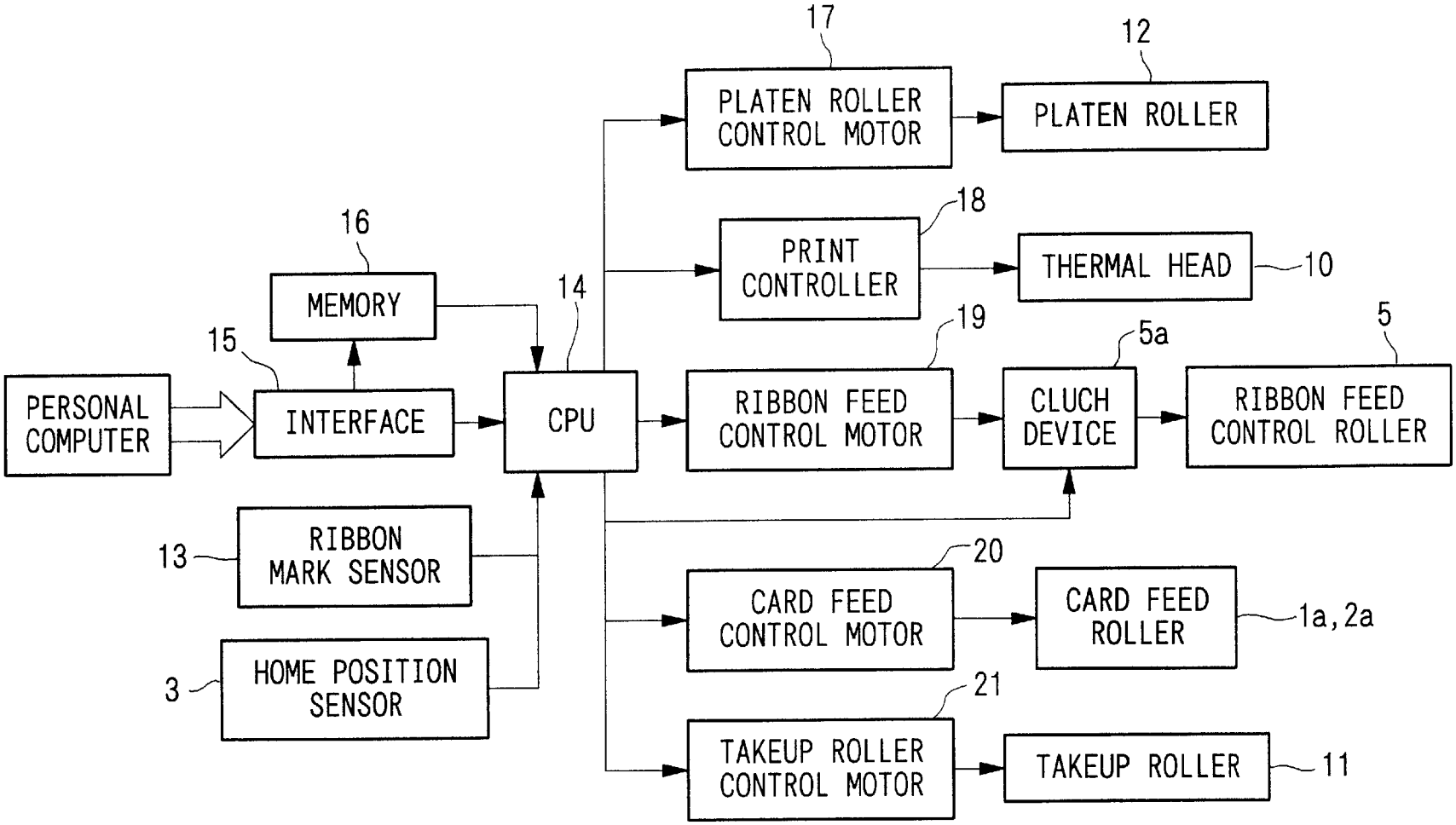
FIG. 3 is a block diagram of the electrical control circuit of an embodiment of the thermal color printer of the present invention.

An embodiment of the thermal color printer will be presented with reference to FIGS. 1 to 3 which show essential components of the printer.

FIG. 1 is a plan view of the print driving system. A flat card (print object) A typically representing a magnetic card, IC card or radio card, has a length dimension of $L_0$, and is vertically positioned, with respect to the plane of the paper in FIG. 1, in preparation for feeding into the print driving system.

The card drive rollers 1*a*, 1*b* hold the card A to transport it to the forward direction indicated by an arrow x, or in the reverse direction. The other set of card drive rollers 2*a*, 2*b* also hold the card A therebetween, and transport tile card A in the forward direction or in the reverse direction. The card A driven by the card rollers 1*a*, 1*b* in the arrow X direction are successively driven by the card drive rollers 2*a*, 2*b*.

A home position sensor 3 is provided to detect the reference position of the card A, and is served typically by a transmission type optical sensor. The home position sensor 3 detects the reference position by detecting the trailing end of the card A. Namely, the reference position is defined when the trailing end of the card A is detected by the home position sensor 3.

An ink ribbon B is supplied from a ribbon supply roller 4 having the ribbon B wound on its outer periphery. The ink ribbon B is driven by a ribbon feed control roller 5 assisted by a pinch roller 6. The ribbon feed control roller 5 and the pinch roller 6 hold the ink ribbon B therebetween to pick up the ink ribbon B wound on the ribbon supply roller 4. The ribbon feed control roller 5 is connected to a driving motor through a clutch device 5*a* to a slipping action against the forwarding force produced by the driving motor, in response to On/Off control for the clutch device 5*a*.

A mechanical brake 7 is provided to apply a drag torque by pressing against the outer periphery of the ribbon supply roller 4 to prevent the ink ribbon B from unwinding off the ribbon supply roller 4. In other words, the ribbon supply roller 4 is a free wheeling roller, and unwinding of the ribbon on the ribbon supply roller 4 is prevented by the action of the mechanical brake 7 applied thereon.

Ribbon guide rollers 8, 9 are disposed, respectively, preceding to and subsequent to a thermal head 10 (to be described later) with respect to the transport direction of the ink ribbon B. The guide rollers 8, 9 are disposed so that the ink ribbon B will be parallel to the card A in the vicinity of the thermal head 10. A takeup roller 11 winds the used portion of the ink ribbon B that has been forwarded from the ribbon supply roller 4 and has taken part in printing action at the thermal head 10.

A platen roller 12 is used to support and transport the card A during the printing process. For thermal transfer printing, the thermal head 10 moves in the vertical direction Y indicated in FIG. 1 to presses the card A and ink ribbon B between itself and the platen roller 12. During this period, the moving speed of card A is controlled by the platen roller 12 and the speed of ink ribbon B is controlled by the ribbon feed control roller 5.

The thermal head 10 is provided with a series of fine heater elements disposed parallel to the width direction of the card A, i.e., in the through paper direction in FIG. 1, over a distance of at least the width dimension of card A. By passing electric current through the heater elements, heat is provided to those regions of the ink ribbon B opposite to the heater elements so that an ink on ink ribbon B heated by the thermal head 10 is transferred onto the card A. The reference numeral 13 is a ribbon mark sensor which may be a reflective type optical sensor, for example. The ribbon mark sensor 13 is utilized to detect the position of an ink coating on the ink ribbon B by directing a beam of light on the ink ribbon B and detecting a reflected beam therefrom.

Next, the construction of the ink ribbon B will be explained with reference to a plan view of the ink ribbon B shown in FIG. 2. The ink ribbon B comprises a strip of base film $b_1$ having heat sublimation type primary colorants, for example, a yellow (Y) color ink $b_2$, a magenta (M) color ink $b_3$ and a cyan (C) color ink $b_4$ and heat melting black (Bk) ink $b_5$ repeatedly distributed at a spacing $L_1$ along its longitudinal direction (in the direction of the ribbon movement).

It should be noted, as explained above, that the heat sublimation type primary colorants, the yellow (Y) color ink $b_2$, magenta (M) color ink $b_3$, and cyan (C) color ink $b_4$, in the heated region are transferred onto the printing object, i.e. Card A, because these inks are applied thickly on the base film $b_1$. Therefore, the same area to which the inks are applied may be repeatedly used for several printings. In contrast, all of the heat melting black color (Bk) ink bs is transferred after one printing onto the card A. The order of the primary colorants need not conform to the order as presented above.

The coating length dimension $L_2$ for the Bk ink $b_5$ is selected to be slightly longer than the card length $L_0$, while the coating length dimension $L_3$ for the Y ink $b_2$, M ink $b_3$, and C ink $b_4$ is selected to be $L_2/N$ (where N is the number of times the multiple-point ribbon can be repeatedly used), and the spacing distance L1 is selected to be less than the coating length dimension $L_2$. The choice for N will be explained later.

The primary colorants, $b_2$, $b_3$, $b_4$ and $b_5$, are associated with respective sensor markings $b_6$~$b_{10}$ placed in the vicinity of the front region of each colorants as illustrated in FIG. 2. The ribbon mark sensor 13 detects the locations of the Y ink $b_2$, M ink $b_3$, C ink $b_4$ and the Bk ink $b_5$, by noting the presence of the sensor markings $b_6$~$b_{10}$.

The electrical system of the thermal color printer will be explained with reference to the block diagram shown in FIG. 3. The electrical system comprises: a CPU (central processor unit: feed distance control means) 14; an interface 15. a memory 16; an platen roller control motor 17; a print controller 18; a ribbon feed control motor 19; a card feed control motor 20; and a takeup roller control motor 21.

CPU 14 commands the entire operation of the thermal color printer according to the control programs stored in the memory 16 and the control signals input from the interface 15. CPU 14 is comprised as an integrated circuit, for example, including an interface circuit for inputting the detected signals from the home position sensor 3 and ribbon mark sensor 13; and another interface circuit for outputting control signals for the platen roller control motor 17, print controller 18 and the ribbon feed control motor (printing medium driving means) 19, card feed control motor 20, takeup roller control motor 21.

Interface 15 is for receiving and demodulating the print signals input from command centers such as personal computer through signal transmission cables. Print signals include color image data and character data such as letters and symbols (termed print data as a group), and command and control signals for printing activities. Interface 15 outputs printing data to memory 16, and outputs command and control signals to CPU 14.

Memory 16 comprises ROM and RAM devices, and ROMs are for storing control programs, and the RAMs are for storing printing data. Memory 16 reads out control programs and printing data in accordance with the instruction from CPU 14 and supplies the readout data to CPU 14.

The platen roller control motor 17 rotates the platen roller according to the print control signals input from CPU 14. The print controller 18 controls electrical power to the thermal head 10 in accordance with the control signals. The ribbon feed control motor 19 is a high precision motor capable of choosing fine rotation angles, a pulse motor for example, and drives the clutch device 5*a* in accordance with the control signals. The clutch device 5*a* is controlled by the On/Off control signals output by CPU 14 as indicated in FIG. 3, and serves to control a transmission of the turning force of the ribbon control motor 19 to the ribbon feed control roller 5. The card feed control motor 20 operates the card feed rollers 1*a*, 2*a* in accordance with the control signals, and the takeup roller control motor 21 operates the takeup roller 11 in accordance with the control signals.

Figure 4:
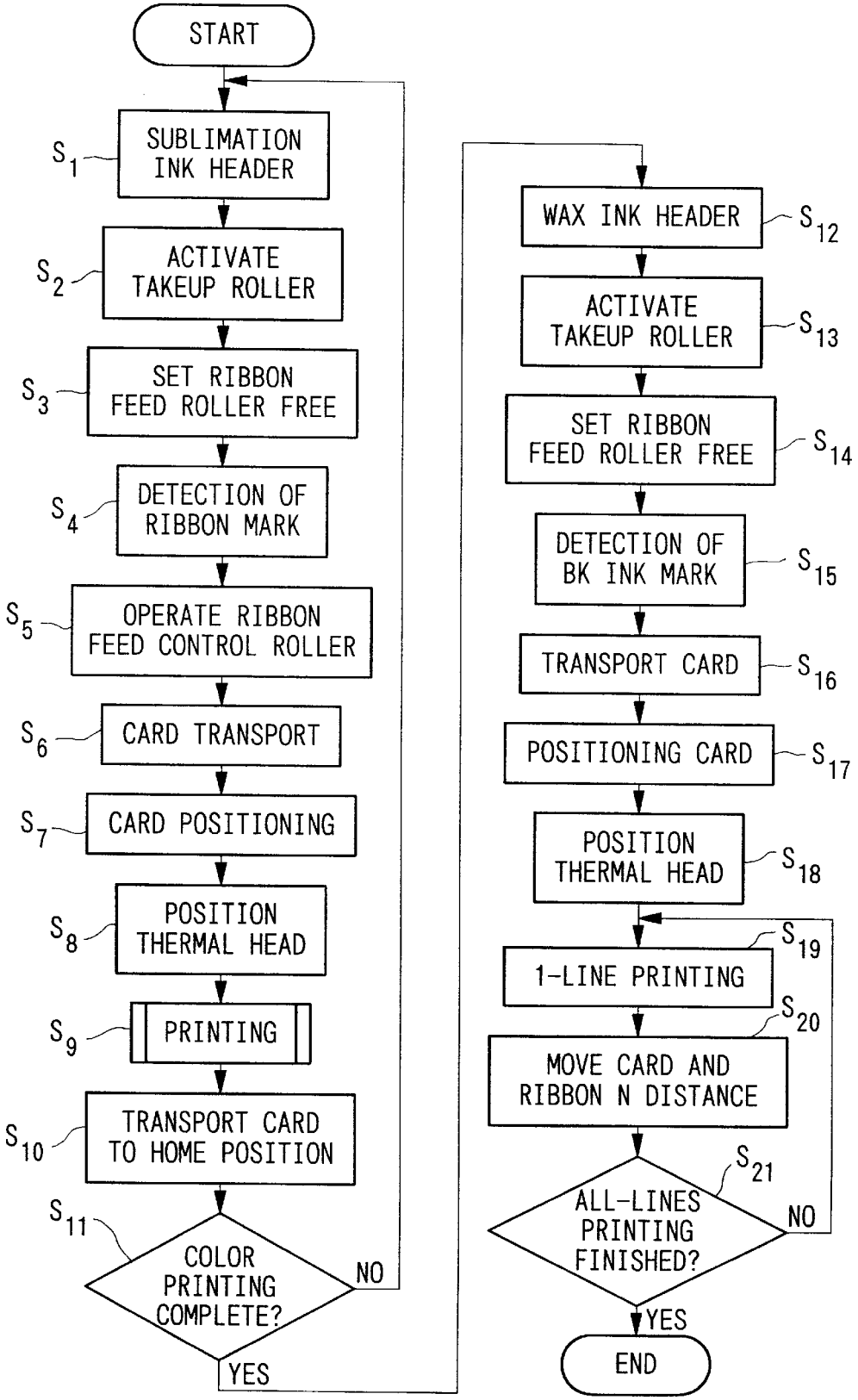
FIG. 4 is a flowchart showing an example of the operation of the thermal color printer of the present invention.
Figure 5:
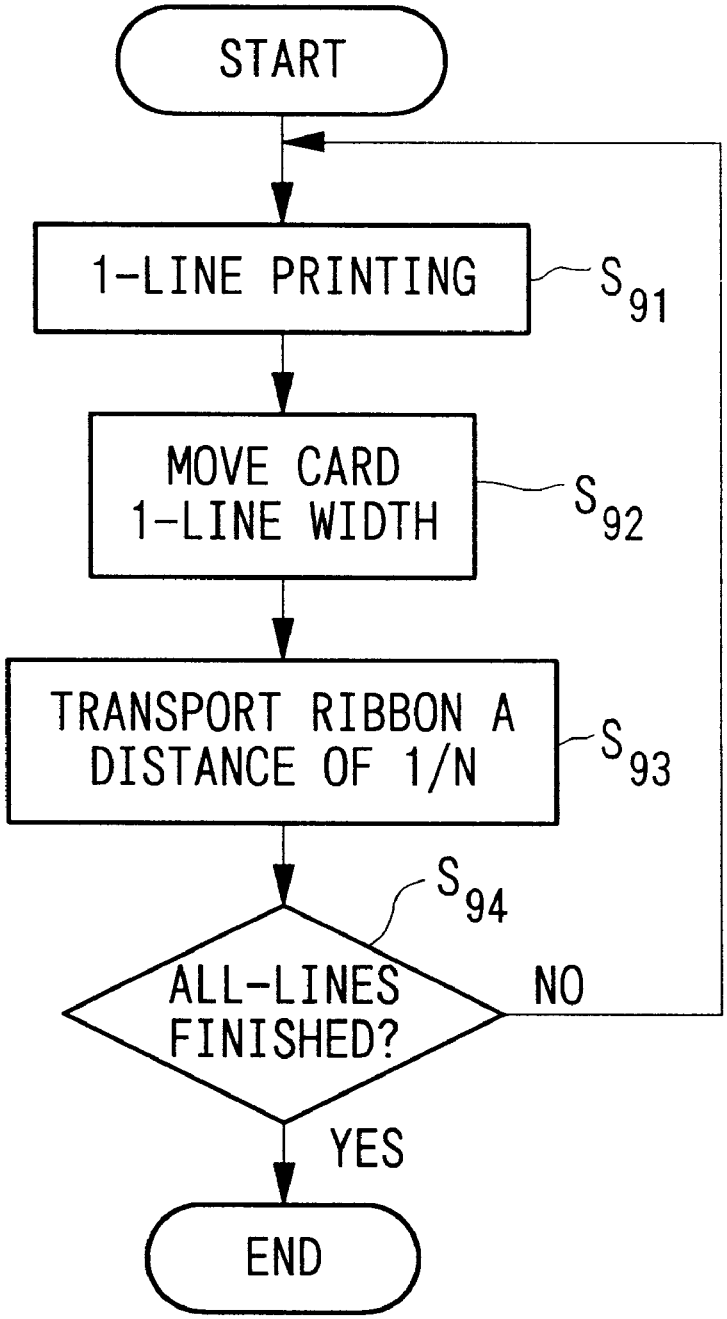
FIG. 5 is a flowchart showing the details of the main steps in the flowchart shown in FIG. 4.

Next, printing operation of the thermal color printer will be explained with reference to the flowcharts shown in FIGS. 4 and 5. FIG. 4 is a flowchart showing the processing steps carried out by CPU 14. CPU 14 carries out color printing steps by using the heat sublimation type Y ink $b_2$, M ink $b_3$, and C ink $b_4$ according to the steps S1~S11.

Step S1 is the header step for the Y ink $b_2$. That is, the takeup roller control motor 21 is activated and the takeup roller 11 is rotated (step S2), the clutch device 5*a* is set in the Off state and the ribbon feed control roller 5 is in the free state (step S3). At this time, the ribbon supply roller 4 is subjected to the braking action by the mechanical brake 7, and in the meanwhile, the takeup roller 11 is placed in a slip state with respect to the takeup roller control motor 21. Therefore, the ink ribbon B is gradually forwarded under a constant applied tension.

When the sensor mark $b_6$ located at the leading end of the Y ink $b_2$ is detected by the ribbon mark sensor 13 (step S4), the clutch device 5*a* is set in the On state and the ribbon feed control roller 5 is made to rotate (step S5). In this condition, the forward speed of the ink ribbon B is governed by the rotational speed of the ribbon feed control motor 5. That is, the takeup roller 11 is in a slip state with reselect to the takeup roller control motor 21 so that the ink ribbon B is under a constant applied tension.

Now, the card feed control motor 20 is activated and the card A is moved forward in the direction of the arrow X (step S6). The card A is positioned at a selected position (home position) directly below the thermal head 10, for example, when the trailing end of card A is detected by the home position sensor 3 (step S7). When the positioning of the card A is completed, the thermal head 10 is roved in the direction of the arrow Y, and the card A and the ink ribbon B are pressed together under pressure (step S8). Printing step can now be started (step S9).

Printing process will be explained with reference to the flowchart shown in FIG. 5. First, printing of 1-line is carried out in step S91. Specifically, CPU 14 commands the print controller 18 to apply electrical power to the thermal head 10, resulting that the ink color heated by the thermal head 10, i.e. a portion of the Y ink $b_2$ over entire 1-line, is transferred onto the card A.

Next, by activating the platen roller control motor 17, the platen roller 12 is rotated, and the card A is moved in the direction of the arrow X over a distance equal to the width of the 1-line (step S92). Also, by activating the ribbon feed control motor 19, the ribbon feed control roller 5 is rotated, and the ink ribbon B is moved, in the direction of the arrow X over a distance equal to (width of the 1-line)·1/N (step S93).

It should be noted that because the ribbon feed control motor 19 is a pulse motor, it is capable of precisely managing fine distances such as (width of the 1-line)·1/N. It should also be noted that, because the ribbon feed control roller 5 is located immediately in front of the thermal head 10, the forwarding force provided to the ink ribbon B by the ribbon feed control roller 5 is applied to the ink ribbon B in the vicinity of thermal head 10 so as to provide precise control over the movement of the irk ribbon B.

When the card A and the ink ribbon B are moved for a pre-determined amount of transport distance, it is examined whether the Y ink $b_2$ has been transferred over all-lines on the card A (step S94). In this instance, only 1-line has been printed, so the result is "No", and the steps S91~S93 are repeated. When the steps S91~S93 are completed over all-lines on the card A, the examination step S94 yield a response "Yes", and the process of printing the yellow (Y) color $b_2$ is completed.

When the printing process for one of the primary color is completed, the card feed roller 1*a* is activated, and the card A is moved in a reverse direction to the arrow X to return the card A to its home position (step S10). At this time, it examines whether all the primary colors, yellow (Y), magenta (M) and cyan (C), have been printed (step S11). In this instance, only the printing process for the yellow (Y) color $b_2$ has been completed, the result is "No" so that the steps S1~S10 are repeated for the magenta (M) color $b_3$, followed by the same steps S1~S10 for the cyan (C) color $b_4$. When all the primary colors, yellow (Y), magenta (M) and cyan (C), have been printed, the result is examination in step S11 becomes "Yes", and the process of printing heat sublimation type ink reaches its completion.

Continuing on, CPU 14 now undertakes printing steps S12~S21 to print characters of symbols using the heat melting type black (Bk) ink $b_5$. That is, CPU 14 carries out the header step for the Bk ink $b_5$. Specifically, the takeup roller 11 is activated (step S13), and the clutch 5*a* is set in the Off state, placing the ribbon feed control roller 5 in a free state (step S14). The ink ribbon B is then gradually forwarded under a constant applied tension.

When the sensor mark $b_9$ located at the leading end of the Bk ink $b_5$ is detected by the ribbon mark sensor 13 (step S15), the clutch device 5*a* is set in the On state and the ribbon feed control roller 5 is made to rotate to transport the ink ribbon B forward according to the rotational speed of the ribbon feed control motor 5.

Continuing on, the card feed roller 1*a* is activated, and the card A is moved in the direction of the arrow X (step S16). When the card A is positioned at a pre-determined location (home position) directly below the thermal head 10 (step S17), the thermal head 10 is moved in the direction of the arrow Y to bring the card A and the ink ribbon B under pressure (step S18). CPU 14 commands the print controller 18 to supply electrical power to the thermal head 10. The resulting is that that portion of the Bk ink $b_5$ over the entire 1-line heated by the thermal head 10 is transferred onto the card A.

Next, the platen roller 12 is activated by activating the platen roller control motor 17, and the card A is forwarded in the direction of the arrow X over a distance of transport corresponding to the width of 1-line of printing (step S92). Also, the ribbon feed control roller 5 is activated, and the ink ribbon B is also moved by the same distance in the direction of the arrow X. That is, for the printing process for the Br ink $b_5$, the ribbon ink B is moved over a transport distance which is equal to N times the transport distance for the Y ink $b_2$. M ink $b_3$ and C ink $b_4$.

Next, it examines whether all-lines on card A have been printed with the Bk ink $b_5$ (step S21). In this instance, only the 1-line has been printed, so the result is "No", and the steps S19 and S20 are repeated. When all-lines on the card A are printed with the Bk ink $b_5$, the result of examination in step S21 becomes "Yes", thus indicating that the printing process for Bk ink $b_5$ has been completed. Accordingly, it signifies that all the printing process for the characters and symbols, involving the heat sublimation type inks and heat melting type ink, has been completed, and the card A is transported out of the printing apparatus by operating the card feed roller.

What is claimed is:

1. A color printer for printing onto a print object comprising:

a thermal printing medium having heat sublimation type inks for multiple-print use and heat melting type inks for single-print use;

transport means including a printing medium driving means for moving said thermal printing medium and the print object in a state of pressed contact;

a thermal head for applying heat to said thermal printing medium to transfer said heat sublimation type inks and said heat melting type inks onto the print object; and printing medium transport distance control means to control said printing medium driving means to vary the transport distance of said thermal printing medium relative to the print object for different distances depending on whether said heat sublimation type inks for multiple-print use are to be heat transferred or said heat melting type inks for single-print use are to be heat transferred to the print object by said thermal head.

2. A color printer as claimed in claim 1, wherein said heat sublimation type inks for multiple-print are for multiple use N number of times, said printing medium transport distance control means selects a printing medium transport distance to be equal to a print object transport distance N for the heat transfer of said heat melting type ink, and selects a printing medium transport distance to be equal to 1/N of a print object transport distance N for the heat transfer of said heat sublimation type ink.

3. A color printer as claimed in claim 1, wherein said printing means provides a movement in the direction of movement of the printing object to said thermal printing medium preceding movement of said thermal head in relation to engaging said thermal printing medium to heat transfer one of said heat meltable and heat sublimation type inks.

4. A color printer as claimed in claim 3, wherein said printing medium driving means comprise:

a roller for pressing against said thermal printing medium;

a pulse motor for rotating said roller through a given rotational angle in accordance with control signals output from said printing medium transport distance control means; and force transmission means disposed between said roller and said pulse motor for controlling application of rotational force of said pulse motor to said roller.

5. A color printer as claimed in claim 1, wherein the print object comprises one of a magnetic card, an integrated circuit card and a radio card.

6. A color printer as in claim 1 wherein said printing medium comprises a ribbon and said printing medium driving means includes a supply roll holding said ribbon, a roller for moving said ribbon pressed against the print object, and a motor responsive to control signals from said printing medium distance control means to rotate said supply roll by different amounts for printing the sublimation type inks and the melting type ink.

7. A color printer as in claim 1 wherein said printing medium distance control means comprises a computer for supplying signals to said motor in accordance with the type of ink to be printed.

* * * * *